US012202703B2

(12) United States Patent
Fukasawa

(10) Patent No.: US 12,202,703 B2
(45) Date of Patent: Jan. 21, 2025

(54) IMAGE FORMING APPARATUS AND CONTROL METHOD THEREFOR

(71) Applicant: KYOCERA Document Solutions Inc., Osaka (JP)

(72) Inventor: Yuki Fukasawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 172 days.

(21) Appl. No.: 17/839,270

(22) Filed: Jun. 13, 2022

(65) Prior Publication Data

US 2022/0402716 A1 Dec. 22, 2022

(30) Foreign Application Priority Data

Jun. 18, 2021 (JP) ..... 2021-101657

(51) Int. Cl.

*B65H 23/04* (2006.01)
*B65H 7/20* (2006.01)
*B65H 39/02* (2006.01)
*B65H 43/02* (2006.01)

(52) U.S. Cl.

CPC ..... *B65H 7/20* (2013.01); *B65H 39/02* (2013.01); *B65H 43/02* (2013.01); *B65H 2301/4318* (2013.01)

(58) Field of Classification Search

CPC ..... G03G 2215/00894; B65H 33/04; B65H 33/12; B65H 2301/4318; B65H 2701/18267; B65H 2701/18269

USPC ..... 270/58.31

See application file for complete search history.

(56) References Cited

U.S. PATENT DOCUMENTS 8,746,671 B2 * 6/2014 Machida ..... B65H 5/26 271/9.13
9,004,483 B2 * 4/2015 Minamisawa ..... B65H 43/02 270/59
9,630,791 B2 * 4/2017 Shiokawa ..... B65H 7/02
11,460,796 B2 * 10/2022 Nishikata ..... B65H 7/02

FOREIGN PATENT DOCUMENTS

JP 2001-026344 A 1/2001

* cited by examiner

*Primary Examiner* — Leslie A Nicholson, III
(74) *Attorney, Agent, or Firm* — Stein IP, LLC

(57) ABSTRACT

An image forming apparatus includes a print portion that prints an image on a sheet passing by a print position, and an inserter that inserts an insert sheet between sheets conveyed one after another. In a print job involving an insert process, the print portion conveys, while securing an insert interval between a preceding sheet, which is a sheet immediately preceding the insert sheet, and a succeeding sheet, which is a sheet immediately following the insert sheet, the preceding sheet and the succeeding sheet one after another. The print portion automatically changes the insert interval according to the length of the insert sheet in the conveyance direction.

9 Claims, 6 Drawing Sheets

IMAGE FORMING APPARATUS AND CONTROL METHOD THEREFOR

INCORPORATION BY REFERENCE

This application is based on and claims the benefit of priority from Japanese Patent Application No. 2021-101657 filed on Jun. 18, 2021, the contents of which are hereby incorporated by reference.

BACKGROUND

The present disclosure relates to an image forming apparatus including an inserter, and to a control method for an image forming apparatus.

Image forming apparatuses are known that can insert insert sheets among a plurality of sheets printed in a print job. Known image forming apparatuses insert insert sheets while conveying, one after another, a plurality of sheets printed in a print job.

SUMMARY

According to one aspect of the present disclosure, an image forming apparatus includes a main conveyance passage, a print portion, and an inserter. The main conveyance passage leads from a cassette, in which sheets are set, to a discharge position via a print position and an insert position. In a print job, the print portion feeds and conveys a sheet from the cassette to the main conveyance passage and prints an image on the sheet passing by the print position. The inserter performs an insert process in which the inserter feeds an insert sheet to the main conveyance passage at the insert position and thereby inserts the insert sheet between sheets conveyed one after another along the main conveyance passage. In the print job involving the insert process, the print portion conveys, while securing an insert interval between a preceding sheet, which is the sheet immediately preceding the insert sheet, and a succeeding sheet, which is the sheet immediately following the insert sheet, the preceding sheet and the succeeding sheet one after another. The print portion automatically chances the insert interval according to the length of the insert sheet in the conveyance direction.

According to another aspect of the present disclosure, a method of controlling an image forming apparatus is one for controlling an image forming apparatus that, in a print job, feeds and conveys a sheet to a main conveyance passage leading via a print position and an insert position to a discharge position and that prints an image on the sheet passing by the print position. The method includes: in a print job involving an insert process in which an insert sheet is fed to the main conveyance passage at the insert position to be inserted between sheets conveyed one after another along the main conveyance passage, conveying, while securing an insert interval between a preceding sheet, which is the sheet immediately preceding the insert sheet, and a succeeding sheet, which is the sheet immediately following the insert sheet, the preceding sheet and the succeeding sheet one after another; and automatically changing the insert interval according to a length of the insert sheet in a conveyance direction.

DETAILED DESCRIPTION

Figure 1:
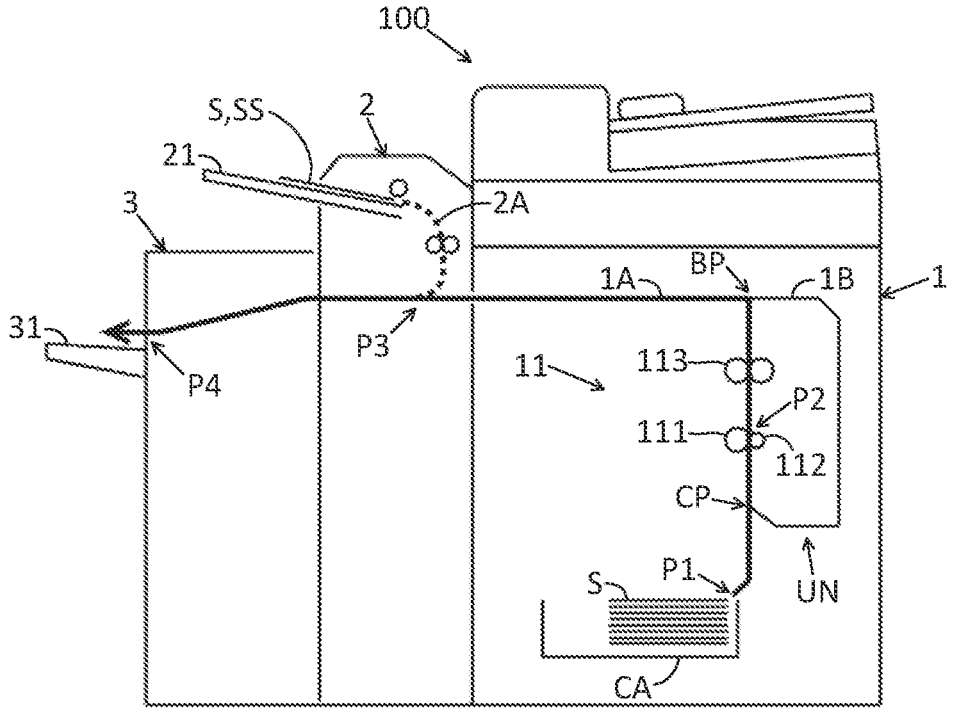
FIG. 1 is a schematic diagram of an image forming apparatus according to an embodiment.

<Construction of an image forming apparatus> As shown in FIG. 1, an image forming apparatus 100 has a printing portion 11 in a main body 1. The printing portion 11 includes a reversing unit UN. In a print job executed by the image forming apparatus 100, the printing portion 11 prints an image on a sheet S. The image forming apparatus 100 also has an inserter 2 and a finisher 3. When viewed from in front of image forming apparatus 100, the main body 1, the inserter 2, and the finisher 3 are arranged in this order from right to left.

The image forming apparatus 100 includes a main conveyance passage 1A. In FIG. 1, the main conveyance passage 1A is indicated by a thick solid-line arrow. In the print job, the sheet S is conveyed along the main conveyance passage 1A. The image is then printed on the sheet S while conveying.

The main conveyance passage 1A extends from a sheet feed position P1 via a print position P2 and an insert position P3 in this order, and reaches a discharge position P4. The main body 1 includes a portion of the main conveyance passage 1A including the sheet feed position P1 and the print position P2. The inserter 2 includes a portion of the main conveyance passage 1A including the insert position P3. The finisher 3 includes a portion of the main conveyance passage 1A including the discharge position P4.

The image forming apparatus 100 further includes a reversing conveyance passage 1B. The reversing conveyance passage 1B is provided in the reversing unit UN. The reversing conveyance passage 1B is used in a print job for printing an image on both the obverse and reverse surfaces of sheet S. Hereinafter, a print job that prints an image only on one side of a sheet S may be referred to as a simplex print job, and a print job that prints an image on both sides of a sheet S may be referred to as a duplex print job.

The reversing conveyance passage 1B branches off the main conveyance passage 1A at a position BP, (hereinafter referred to as the branch position BP downstream of the print position P2 in the sheet conveyance direction), and connects to the main conveyance passage 1A at a position CP (hereinafter, referred to as the connection position CP) upstream of the print position P2 in the sheet conveyance direction. The branch position BP is a position upstream of the insert position P3 in the sheet conveyance direction. The connection position CP is a position downstream of the sheet feed position P1 in the sheet conveyance direction.

The printing portion 11 feeds the sheet S to the main conveyance passage 1A at the sheet feed position P1. A cassette CA is disposed at the sheet feed position P1. That is, the main conveyance passage 1A extends from the cassette CA via the print position P2 and the insert position P3. The sheet S is set in the cassette CA.

Though not illustrated, the printing portion 11 includes a sheet feed roller. The sheet feed roller is in contact with the sheet S in the cassette CA and rotates in that state. As a result, the sheet S is pulled out from the cassette CA and is fed to the main conveyance passage 1A.

Though not illustrated, the printing portion 11 also includes a pair of conveyance rollers. The pair of conveyance rollers is provided in the main conveyance passage 1A and the reversing conveyance passage 1B. The pair of conveyance rollers rotates and thereby conveys the sheet S. The number of pairs of conveyance rollers provided in the main conveyance passage 1A and their positions can be changed according to the shape, length, and the like of the main conveyance passage. The number of pairs of conveyance rollers provided in the reversing conveyance passage 1A and their positions can also be changed according to the shape, length, and the like of the reversing conveyance passage.

The printing portion 11 includes a photosensitive drum 111 and a transfer roller 112. The photosensitive drum 111 and the transfer roller 112 are in pressed contact with each other. This forms a transfer nip between the photosensitive drum 111 and the transfer roller 112. The position of the transfer nip is the print position P2.

Though not illustrated, the printing portion 11 includes a charging device, an exposure device, and a developing device. The charging device electrostatically charges the circumferential surface of the photosensitive drum 111. The exposure device forms an electrostatic latent image on the circumferential surface of the photosensitive drum 111. The developing device develops the electrostatic latent image into a toner image.

The sheet S being conveyed enters the transfer nip. As a result, the toner image is transferred to the sheet S. The sheet S having the toner image transferred to it is conveyed as it is.

The printing portion 11 includes a pair of fixing rollers 113. The pair of fixing rollers 113 has a fixing nip downstream of the print position P2 in the sheet conveyance direction. The sheet S having the toner image transferred to it enters the fixing nip. The pair of fixing rollers 113 heats and presses the sheet S having entered the fixing nip and thereby fixes the toner image to the sheet S.

In a simplex print job, the printing portion 11 conveys the sheet S having an image printed on one side (here referred to as a simplex print sheet S) along the main conveyance passage 1A. The simplex print sheet S is conveyed to the inserter 2.

In a duplex print job, the printing portion 11 switches back the simplex print sheet S having passed through the fixing nip. The printing portion 11 then draws the switched back simplex print sheet S from the branch position BP into the reversing conveyance passage 1B. After that, the printing portion 11 conveys the simplex print sheet S along the reversing conveyance passage 1B and returns the simplex print sheet S to the main conveyance passage 1A at a position upstream of the print position P2 in the sheet conveyance direction. That is, printing portion 11 feeds the sheet S in the reversing conveyance passage 1A back to the main conveyance passage 1A at the connection position CP.

In a duplex print job, the print portion 11 conveys the sheet S fed back to the main conveyance passage 1A to the print position P2. When the sheet S fed back to the main conveyance passage 1A passes by the print position P2, the obverse and reverse sides of the sheet S have been reversed, and thus an image is printed on the unprinted side, out of the two sides, of the sheet S. The sheet S having the images printed on both sides is conveyed along the main conveyance passage 1A and is carried into the inserter 2.

The inserter 2 includes a set tray 21 on which to set the sheet S. The inserter 2 also includes an insert conveyance passage 2A. In FIG. 1, the insert conveyance passage 2A is indicated by a thick broken line for distinction from the main conveyance passage 1A. The insert conveyance passage 2A leads from the set tray 21 to the insert position P3. The insert conveyance passage 2A connects to the main conveyance passage 1A at the insert position P3.

The inserter 2 conveys the sheet S set on the set tray 21, along the insert conveyance passage 2A. The inserter 2 then feeds the sheet S in the insert conveyance passage 2A to the main conveyance passage 1A at the insert position P3. That is, the insert position P3 is a sheet feed position at which the sheet S is fed from the inserter 2 to the main conveyance passage 1A.

The inserter 2 feeds the sheet S to the main conveyance passage 1A at the insert conveyance passage 2A, then conveys the sheet S along the main conveyance passage 1A. Thereby the sheet S is carried from the inserter 2 into the finisher 3.

The inserter 2 performs an insert process. In a print job that involves the insert process, the inserter 2 accepts the sheet S from the print portion 11. The inserter 2 conveys the sheet S set in the set tray 21 along the insert conveyance passage 2A. The inserter 2 then feeds the sheet S in the insert conveyance passage 2A to the main conveyance passage 1A at the insert point P3.

In a print job involving the insert process, a sheet S to be inserted before, after, or both of the sheet S printed by the print portion 11 is set in the set tray 21. Any of various types of sheet S, such as a cardboard, an index sheet, and the like can be inserted. Hereinafter, to differentiate from the sheet S having the image printed on it by the print portion 11, the sheet S set in the inserter 2 (set tray 21) may be referred to as the insert sheet SS.

The finisher 3 accepts the sheet S from the inserter 2 and then conveys it along the main conveyance passage 1A. For instance, the finisher 3 has a function of performing a post-processing such as a punching process on the sheet S. The finisher 3 discharges the sheet S to a discharge tray 31.

Figure 2:
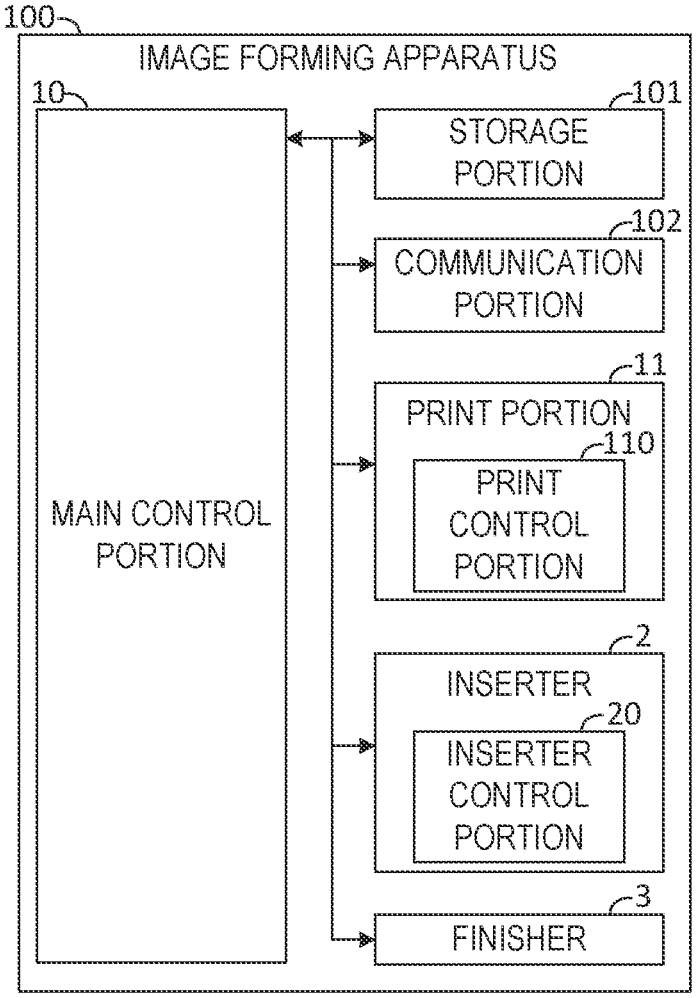
FIG. 2 is a block diagram of the image forming apparatus according to the embodiment.

As shown in FIG. 2, the image forming apparatus 100 has a main control portion 10. The main control portion 10 includes processing circuits such as a CPU, an ASIC, and the like. The main control portion 10 controls the image forming apparatus 100. The main control portion 10 also performs various kinds of processing, such as image processing on image data.

The main control portion 10 controls the printing portion 11. The main control portion 10 also controls the inserter 2 and the finisher 3.

The image forming apparatus 100 has a storage portion 101. The storage portion 101 includes storage devices such as a ROM, a RAM, an HDD, and the like. The storage portion 101 is connected to the main control portion 10. The main control portion 10 read information from the storage portion 101. The main control portion 10 also writes information to the storage portion 101.

The image forming apparatus 100 has a communication portion 102. The communication portion 102 includes a communication circuit. The communication portion 102 is connected to, so as to be able to communicate with, an external device (not illustrated) across a network. The external device can be a personal computer (user terminal) used by a user. For example, print data (e.g., PDL data) for a print job is transmitted from the user terminal to the image forming apparatus 100.

The print portion 11 has a print control portion 110. The print control portion 110 includes a CPU, a memory, and the like. The print control portion 110 is connected to the main control portion 10. The main control portion 10 gives a control instruction related to a print job (including feeding and conveying of the sheet S) to the print control portion 110. Based on the control instruction from the main control portion 10, the print control portion 110 controls the print operation of the print portion 11.

For example, the print control portion 110 controls the timing with which to feed the sheet S from the cassette CA to the main conveying passage 1A. The print control portion 110 also controls the timing with which to feed the sheet S from the reversing conveyance passage 1B in the reversing unit UN back to the main conveyance passage 1A. By controlling the timing of feeding (and feeding-back) of the sheet S, an appropriate interval is provided between a sheet S fed ahead and the sheet S fed subsequently.

The inserter 2 has an inserter control portion 20. The inserter control portion 20 includes a CPU, a memory, and the like. The inserter control portion 20 is connected to the main control portion 10. The main control portion 10 gives a control instruction related to an insert process to the inserter control portion 20. Based on the control instruction from the main control portion 10, the inserter control portion 20 controls the insert process. For example, the inserter control portion 20 controls the sheet feed timing of the sheet S from the inserter conveyance passage 2A to the main conveyance passage 1A.

<Sheet feeding control> The main control portion 10 gives a control instruction related to the feeding of the sheet S to the print portion 11 (print control portion 110) based on information indicating the sheet feed source of each sheet S fed in the print job. In a print job that involves the insert process, a sheet S from the cassette CA as the sheet source and a sheet S from the inserter 2 as the sheet feed source are mixed.

The print portion 11 recognizes the sheet feed source of each sheet S fed in the print job based on the control instruction from the main control portion 10. The print portion 11 then controls sheet feeding for the print job that involves the insert process.

First, a description will be given of a case where, in a simplex print job, the sheet feed source of the Nth sheet is the inserter 2. The fact that the sheet feed source of the Nth sheet is the inserter 2 means that the Nth sheet is an insert sheet SS.

In the simplex print job, when the sheet feed source of the Nth sheet is the inserter 2 (when the Nth sheet is an insert sheet SS), the main control portion 10 sets the timing for a case where, after a sheet S corresponding to the insert sheet SS (a sheet S with the same length in the conveyance direction as the insert sheet SS) is fed from the cassette CA to the main conveyance passage 1A, the (N+1)th sheet S is fed from the cassette CA to the main conveyance passage 1A as the timing at which the (N+1)th sheet S is fed from the cassette CA to the main conveyance passage 1A. The main control portion 10 then gives the print portion 11 (prim control portion 110) an instruction to feed the (N+1)th sheet S from the cassette CA to the main conveyance passage 1A at the so set sheet feed timing.

Here, the main control portion 10 sets the sheet feed timing of the (N+1)th sheet S based on the length of the insert sheet SS in the conveyance direction. The longer the insert sheet SS is in the conveyance direction, the more the main control portion 10 delays the sheet feed timing of the (N+1)th sheet S. The shorter the insert sheet SS is the conveyance direction, the more the main control portion 10 expedites the sheet feed timing of the (N+1)th sheet S. That is, the main control portion 10 changes the sheet feed timing of the (N+1)th sheet S according to the length of the insert sheet SS in the conveyance direction.

When the sheet feed source of the Nth sheet is the inserter 2, the print portion 11 does not feed the Nth sheet from the cassette CA, In this case, the print portion 11 feeds the (N+1)th sheet S from the cassette CA to the main conveyance passage 1A at the timing for a case where, after a sheet S corresponding to the insert sheet SS is fed from the cassette CA to the main conveyance passage 1A, the (N+1)th sheet S is fed from the cassette CA to the main conveyance passage 1A (i.e., at the sheet feed timing as instructed by the main control portion 10). In other words, the print portion 11 actually does not feed the insert sheet SS from the cassette CA to the main conveyance passage 1A. Even so, the print portion 11 assumes that it has fed the insert sheet SS from the cassette CA to the main conveyance passage 1A and controls the sheet feed timing of the sheet S fed subsequently from the cassette CA to the main conveyance passage 1A.

Figure 3:
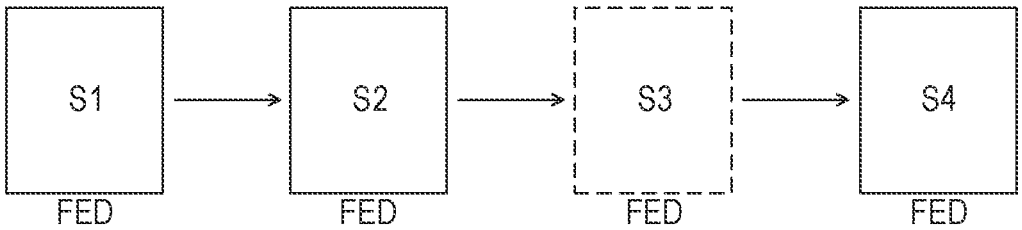
FIG. 3 is a diagram showing a timing of sheet feeding (in a simplex print job) by a print portion in the image forming apparatus according to the embodiment.

For example, as shown in FIG. 3, suppose that the sheet feed source of the first sheet S1, the second sheet S2, and the fourth sheet S4 is the cassette CA, and that the sheet feed source of the third sheet S3 is the inserter 2. That is, the third sheet S3 is an insert sheet SS, and is inserted between the sheets S2 and S4.

In the example shown in FIG. 3, first, the print portion 11 feeds the sheet S1 from the cassette CA to the main conveyance passage 1A (prints an image on the sheet S1). The print portion 11 then feeds the sheet S2 from the cassette CA to the main conveyance passage 1A (prints an image on the sheet S2) at such a timing that the interval (between papers) in the conveyance direction between the trailing end of the sheet S1 in the conveyance direction and the leading end of the sheet S2 in the conveyance direction equals a predetermined interval.

After feeding the sheet S2 from the cassette CA to the main conveyance passage 1A, the print portion 11 actually does not feed the sheet S3 from the cassette CA to the main conveyance passage 1A. Even so, the print portion 11 feeds the sheet S4 from the cassette CA to the main conveyance passage 1A at the same timing as when, after the sheet S3 is fed from the cassette CA to the main conveyance passage 1A, the sheet S4 is fed from the cassette CA to the main conveyance passage 1A.

Next, a description will be given of a case where, in a duplex print job, the sheet feed source of the Nth sheet is the inserter 2. A duplex print job can be a standard duplex print job and a high-speed duplex print job.

In the standard duplex print job, an image is printed on one side of the sheet S fed from the cassette CA to the main conveyance passage 1A and thus the sheet S in drawn into the reversing conveyance passage 1B. The sheet S having the image printed on one side is fed from the reversing conveyance passage 1B back to the main conveyance passage 1A and then the sheet S on Which to print an image next is fed from the cassette CA to the main conveyance passage 1A.

In the standard duplex print job, when the sheet feed source of the Nth sheet is the inserter 2, the main control portion 10 sets the timing for a case where, after a sheet S corresponding to the insert sheet SS as the Nth sheet is fed from the cassette CA to the main conveyance passage 1A, the (N+1)th sheet S is fed from the cassette CA to the main conveyance passage 1A as the timing at which the (N+1)th sheet S is fed from the cassette CA to the main conveyance passage 1A. The main control portion 10 then gives the print portion 11 (print control portion 110) an instruction to feed the (N+1)th sheet S from the cassette CA to the main conveyance passage 1A at the so set sheet feed timing.

Here, as in the simplex print job, the main control portion 10 sets the sheet feed timing of the (N+1)th sheet S based on the length of the insert sheet SS in the conveyance direction. The longer the insert sheet SS is in the conveyance direction, the more the main control portion 10 delays the sheet feed timing of the (N+1)th sheet S. The shorter the insert sheet SS is the conveyance direction, the more the main control portion 10 expedites the sheet feed timing of the (N+1)th sheet S. That is, the main control portion 10 changes the sheet feed timing of the (N+1)th sheet S according to the length of the insert sheet SS in the conveyance direction.

When the sheet feed source of the Nth sheet is the inserter 2, the print portion 11 does not feed the Nth sheet from the cassette CA. In this case, the print portion 11 feeds the (N+1)th sheet S from the cassette CA to the main conveyance passage 1A at the timing for a case where, after a sheet S corresponding to the insert sheet SS as the Nth sheet is fed from the reversing conveyance passage 1B back to the main conveyance passage 1A, the (N+1)th sheet S is fed from the cassette CA to the main conveyance passage 1A (i.e., at the sheet feed timing as instructed by the main control portion 10). In other words, the print portion 11 actually does not feed the insert sheet SS from the cassette CA to the main conveyance passage 1A (does not feed the insert sheet SS from the reversing conveyance passage 1B back to the main conveyance passage 1A). Even so, the print portion 11 assumes that it has fed the insert sheet SS from the cassette CA to the main conveyance passage 1A (assumes that it has fed the insert sheet SS from the reversing conveyance passage 1B back to the main conveyance passage 1A) and controls the sheet feed timing of the sheet S fed subsequently from the cassette CA to the main conveyance passage 1A.

Figure 4:
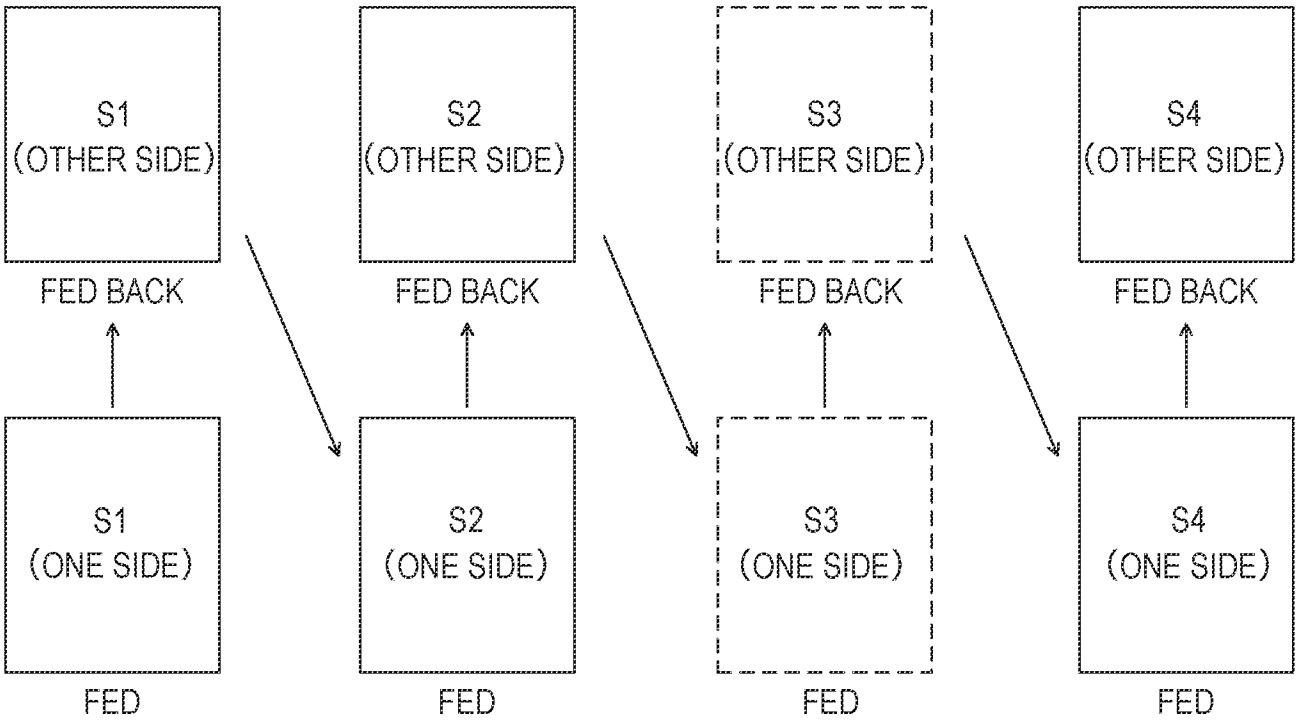
FIG. 4 is a diagram showing a timing of sheet feeding (in a standard duplex print job) by the print portion in the image forming apparatus according to the embodiment.

For example, as shown in FIG. 4, suppose that the sheet feed source of the first sheet S1, the second sheet S2, and the fourth sheet S4 is the cassette CA, and that the sheet feed source of the third sheet S3 is the inserter 2. That is, the third sheet S3 is an insert sheet SS, and is inserted between the sheets S2 and S4.

In the example shown in FIG. 4, first, the print portion 11 feeds the sheet S1 from the cassette CA to the main conveyance passage 1A (prints an image on one side of the sheet S1). Subsequently, the print portion 11 carries the sheet S1 into the reversing conveyance passage 1B and feeds the sheet S1 from the reversing conveyance passage 1B back to the main conveyance passage 1A (prints an image on the other side of the sheet S1). The print portion 11 then feeds the sheet S2 from the cassette CA to the main conveyance passage 1A (prints an image on one side of the sheet S2) at such a timing that the interval (between sheets) in the conveyance direction between the trailing end of the sheet S1 in the conveyance direction and the leading end of the sheet S2 in the conveyance direction equals a predetermined interval for a duplex print job. The sheet S2, like the sheet S1, is carried into the reversing conveyance passage 1B and fed from the reversing conveyance passage 1B back to the main conveyance passage 1A (an image is printed on the other side of the sheet S2).

After feeding the sheet S2 from the reversing conveyance passage 1B back to the main conveyance passage 1A, the print portion 11 actually does not feed the sheet S3 from the cassette CA to the main conveyance passage 1A. That is, the print portion 11 actually does not feed the sheet S3 from the reversing conveyance passage 1B back to the main conveyance passage 1A. Even so, the print portion 11 feeds the sheet S4 from the cassette CA to the main conveyance passage 1A at the timing for a case where, after the sheet S3 is fed from the reversing conveyance passage 1B to the main conveyance passage 1A, the sheet S4 is fed from the cassette CA to the main conveyance passage 1A (prints an image on one side of the sheet S4). The sheet S4, as with the sheet S1, carried into the reversing conveyance passage 1B and is fed from the reversing conveyance passage 1B back to the main conveyance passage 1A (an image is printed on the other side of the sheet S4).

In the standard duplex print job, not a plurality of sheets S circulate in the reversing conveyance passage 1B at the same time. On the other hand, in the high-speed duplex print job, a plurality of sheets S circulate in the reversing conveyance passage 1B at the same time. Accordingly, in the high-speed duplex print job, the duplex print job finishes quickly.

In the high-speed duplex print job, an image is printed on one side of the sheet S (here referred to as a first sheet S) fed from the cassette CA to the main conveyance passage 1A and the switched back first sheet S is drawn into the reversing conveyance passage 1B at the branch position BP. Before the first sheet S is fed back to the main conveyance passage 1A at the reversing conveyance passage 1B (connection position CP), the following sheet S (here referred to as a second sheet S) after the first sheet S is fed from the cassette CA to the main conveyance passage 1A and an image is printed on one side of the second sheet S.

The second sheet S is drawn into the reversing conveyance passage 1B at the branch position BP and circulates the reversing conveyance passage 1B together with the first sheet S. Subsequently, the first sheet S is fed from the reversing conveyance passage 1B (connection position CP) back to the main conveyance passage 1A and an image is printed on the other side of the first sheet S. After the first sheet S is fed from the reversing conveyance passage 1B (connection position CP) back to the main conveyance passage 1A, before the second sheet S is fed from the reversing conveyance passage 1B (connection position CP) back to the main conveyance passage 1A, the following sheet S (here referred to as a third sheet S) after the second sheet S is fed from the cassette CA to the main conveyance passage 1A and an image is printed on one side of the third sheet S.

The third sheet S is drawn into the reversing conveyance passage 1B at the branch position BP and circulates in the reversing conveyance passage 1B together with the second sheet S. From then on, as with the first sheet S, the other side of the second sheet S is printed and the other side of the third sheet S is printed. When there is a sheet S (here referred to as a fourth sheet S) on which to print an image subsequently to the third sheet S, then after the second sheet S is fed from the reversing conveyance passage 1B (connection position CP) back to the main conveyance passage 1A, before the third sheet S is fed from the reversing conveyance passage 1B (connection position CP) back to the main conveyance passage 1A, the fourth sheet S is fed from the cassette CA to the main conveyance passage 1A.

Thus, in the high-speed duplex print job, after the Nth sheet S is fed from the cassette CA to the main conveyance passage 1A, the (N−1)th sheet S is fed from the reversing conveyance passage 1B back to the main conveyance passage 1A. After the Nth sheet S is fed from the reversing conveyance passage 1B back to the main conveyance passage 1A, the (N+2)th sheet S is fed from the cassette CA to the main conveyance passage 1A.

In the high-speed duplex print job, when the sheet feed source of the Nth sheet is the inserter 2, the main control portion 10 sets the timing for a case where, after a sheet S corresponding to the insert sheet SS as the Nth sheet is fed from the cassette CA to the main conveyance passage 1A, the (N−1)th sheet S is fed from the reversing conveyance passage 1B back to the main conveyance passage 1A as the timing at which the (N−1)th sheet S is fed from the reversing conveyance passage 1B back to the main conveyance passage 1A. The main control portion 10 then gives the print portion 11 (print control portion 110) an instruction to feed the (N−1)th sheet S from the reversing conveyance passage 1B back to the main conveyance passage 1A at the so set sheet feed timing.

In the high-speed duplex print job, when the sheet feed source of the Nth sheet is the inserter 2, the main control portion 10 sets the timing for a case where, after a sheet S corresponding to the insert sheet SS as the Nth sheet is fed from the reversing conveyance passage 1B back to the main conveyance passage 1A, the (N+2)th sheet S is fed from the cassette CA to the main conveyance passage 1A as the timing at which the (N+2)th sheet S is fed from the cassette CA to the main conveyance passage 1A. The main control portion 10 then gives the print portion 11 (print control portion 110) an instruction to feed the (N+2)th sheet S from the cassette CA to the main conveyance passage 1A at the so set sheet feed timing.

Here, the main control portion 10 sets the sheet feeding-back timing of the (N−1)th sheet S and the sheet feed timing of the (N+2)th sheet S based on the length of the insert sheet SS in the conveyance direction. The longer the insert sheet SS is in the conveyance direction, the more the main control portion 10 delays the sheet feeding-back timing of the (N−1)th sheet S and the sheet feed timing of the (N+2)th sheet S. The shorter the insert sheet SS is the conveyance direction, the more the main control portion 10 expedites the sheet feeding-back timing of the (N−1)th sheet S and the sheet feed timing of the (N−2)th sheet S. That is, the main control portion 10 changes the sheet feeding-back timing of the (N−1)th sheet S and the sheet feed timing of the (N+2)th sheet S according to the length of the insert sheet SS in the conveyance direction.

When the sheet feed source of the Nth sheet is the inserter 2, the print portion 11 does not feed the Nth sheet from the cassette CA. In this case, the print portion 11 feeds the (N−1)th sheet S from the reversing conveyance passage 1B back to the main conveyance passage 1A at the timing for a case where, after a sheet S corresponding to the insert sheet SS as the Nth sheet is fed from the cassette CA to the main conveyance passage 1A, the (N−1)th sheet S is fed from the reversing conveyance passage 1B back to the main conveyance passage 1A (i.e., at the sheet feeding back timing as instructed by the main control portion 10). In other words, the print portion 11 actually does not feed the insert sheet SS from the cassette CA to the main conveyance passage 1A. Even so, the print portion 11 assumes that it has fed the insert sheet SS from the cassette CA to the main conveyance passage TA and controls the sheet feeding back timing of the sheet S fed subsequently from the reversing conveyance passage 1B back to the main conveyance passage 1A.

The print portion 11 feeds the (N+2)th sheet S from the cassette CA to the main conveyance passage 1A at the timing for a case where, after a sheet S corresponding to the insert sheet SS as the Nth sheet is fed back from the reversing conveyance passage 1B to the main conveyance passage 1A, the (N+2)th sheet S is fed from the cassette CA to the main conveyance passage 1A (i.e., at the sheet feeding back timing as instructed by the main control portion 10). In other words, the print portion 11 actually does not feed the insert sheet SS from the reversing conveyance passage 1B back to the main conveyance passage 1A. Even so, the print portion 11 assumes that it has fed the insert sheet SS from the reversing conveyance passage 1B to the main conveyance passage 1A and controls the sheet feeding back timing of the sheet S fed subsequently from the cassette CA to the main conveyance passage 1A.

Figure 5:
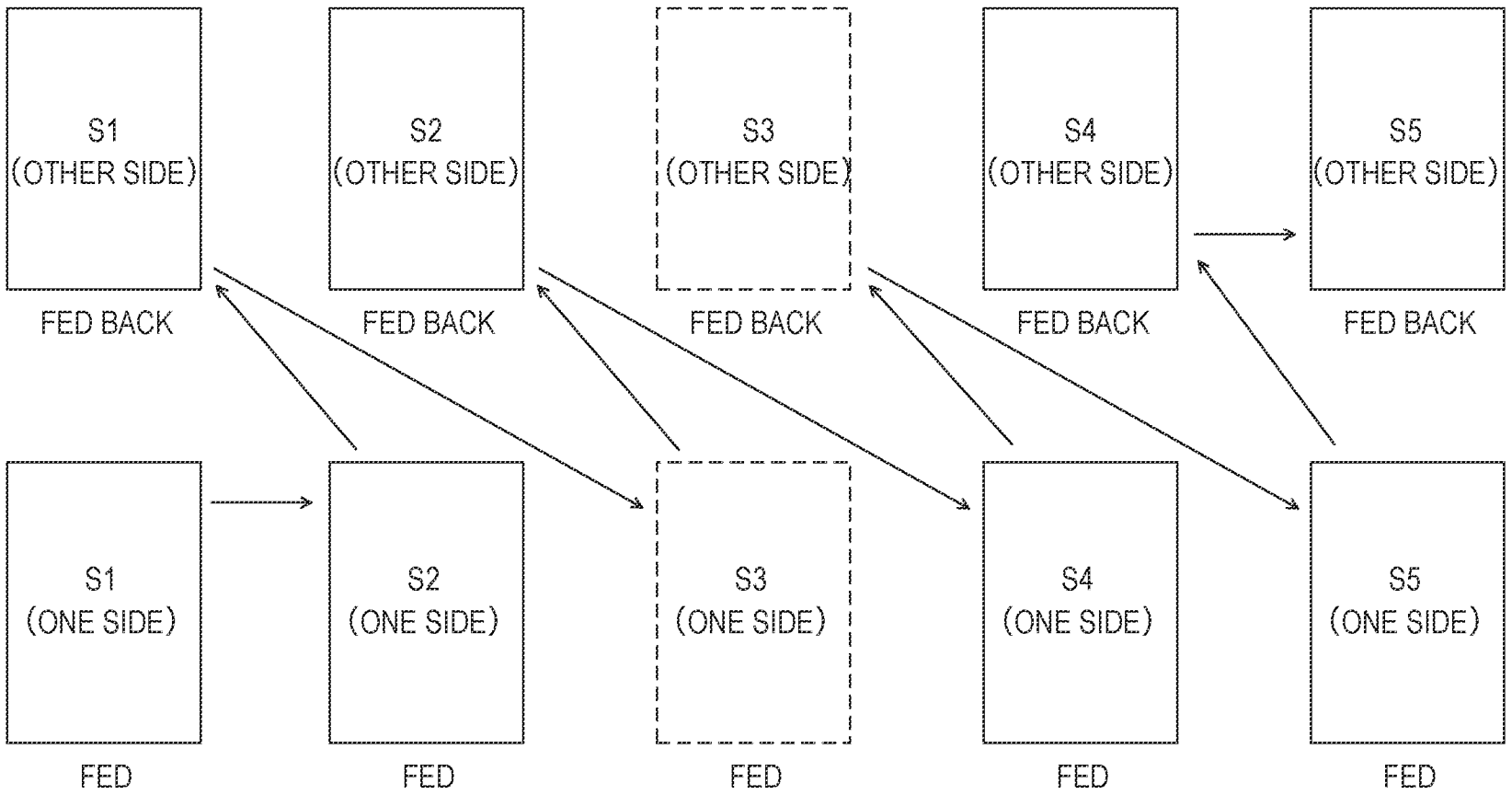
FIG. 5 is a diagram indicating a timing of sheet feeding (in a high-speed duplex print job) by the print portion in the image forming apparatus according to the embodiment.

For example, as shown in FIG. 5, suppose that the sheet feed source of the first sheet S1, the second sheet S2, the fourth sheet S4, and the fifth sheet S5 is the cassette CA, and that the sheet feed source of the third sheet S3 is the inserter 2. That is, the third sheet S3 is an insert sheet SS, and is inserted between the sheets S2 and S4.

In the example shown in FIG. 5, first, the print portion 11 feeds the sheet S1 from the cassette CA to the main conveyance passage 1A (prints an image on one side of the sheet S1). Subsequently, the print portion 11 carries the sheet S1 into the reversing conveyance passage 1B. Before feeding the sheet S1 from the reversing conveyance passage 1B back to the main conveyance passage 1A, the print portion 11 feeds the sheet S2 from the cassette CA to the main conveyance passage 1A (prints an image on one side of the sheet S2). The print portion 11 carries the sheet S2 into the reversing conveyance passage 1B.

Next, the print portion 11 feeds the sheet S1 from the reversing conveyance passage 1B back to the main conveyance passage 1A (prints an image on the other side of the sheet S1). After feeding the sheet S1 back, the print portion 11 actually does not feed the sheet S3 from the cassette CA to the main conveyance passage 1A. Even so, the print portion 11 feeds the sheet S2 from the reversing conveyance passage 1B back to the main conveyance passage 1A (prints an image on the other side of the sheet S2) at the timing for a case where, after the sheet S3 is fed from the cassette CA to the main conveyance passage 1A, the sheet S2 is fed from the reverse conveyance passage 1B back to the main conveyance passage 1A.

After feeding the sheet S2 back, the print portion 11 feeds the sheet S4 from the cassette CA to the main conveyance passage 1A (prints an image on one side of the sheet S4). After feeding the sheet S4, the print portion 11 actually does not feed the sheet S3 from the reversing conveyance passage 1B to the main conveyance passage 1A. Even so, the print portion 11 feeds the sheet S5 from the cassette CA to the main conveyance passage 1A (prints an image on one side of the sheet S5) at the timing for a case where, after the sheet S3 is fed from the reversing conveyance passage 1B to the main conveyance passage 1A, the sheet S5 is fed from the cassette CA to the main conveyance passage 1A. The print portion 11 carries the sheet S5 into the reversing conveyance passage 1B.

Next, the print portion 11 feeds the sheet S4 from the reversing conveyance passage 1B back to the main conveyance passage 1A (prints an image on the other side of the sheet S4). If the sheet S5 is the last one, the print portion 11 feeds the sheet S5 from the reversing conveyance passage 1B back to the main conveyance passage 1A (prints an image on the other side of the sheet S5).

Figure 6:
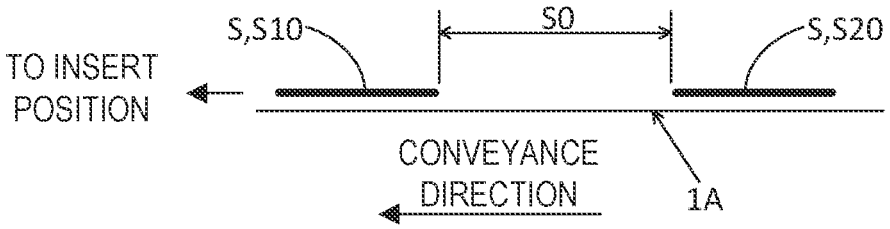
FIG. 6 is a diagram showing a positional relationship between a preceding sheet and a succeeding sheet traveling along the main conveyance passage of the image forming apparatus according to the embodiment.

Through sheet feed control for the print job that involves the insert process, as shown in FIG. 6, the print portion 11 conveys, while securing an insert interval S0 between a preceding sheet S10, which is the sheet S immediately preceding the insert sheet SS, and a succeeding sheet S20, which is the sheet S immediately following the insert sheet SS, the preceding sheet S10 and the succeeding sheet S20 one after the other. The print portion 11 changes the insert interval S0 according to the length of the insert sheet SS in the conveyance direction. Note that the insert interval S0 is greater than the length, in the conveyance direction, of the insert sheet SS inserted between the preceding sheet S10 and the succeeding sheet S20.

The inserter 2 inserts the insert sheet SS between the preceding sheet S10 and the succeeding sheet S20. Specifically, in a print job that involves the insert process, the inserter 2 feeds the insert sheet SS to the main conveyance passage 1A at the insert position P3 after the trailing end, in the conveyance direction, of the preceding sheet S10 being conveyed along the main conveyance passage 1A passes by the insert position P3. Here, after the trailing end of the preceding sheet S10 in the conveyance direction passes by the insert position P3, before the leading end of the succeeding sheet S20 in the conveyance direction reaches the insert position P3, the inserter 2 completes the feeding of the insert sheet SS to be inserted between the preceding sheet S10 and the succeeding sheet S20.

In this embodiment, as described above, the main control portion 10 gives the print portion 11 (print control portion 110) a control signal related to a print job that involves an insert process. For example, the control signal related to a print job that involves an insert process, includes a signal indicating the length of the insert sheet SS in the conveyance direction. Based on this control signal, the print portion 11 recognizes the length, in the conveyance direction, of the insert sheet SS inserted among the plurality of sheets S printed in the print job that involves the insert process.

The print portion 11 then automatically changes the insert interval S0 according to the length of the insert sheet SS in the conveyance direction. The greater the insert sheet SS is in the conveyance direction, the print control portion 11 increases the insert interval S0. The smaller the insert sheet SS is the conveyance direction, the print control portion 11 reduces the insert interval S0. That is, the print control portion 11 sets the insert interval S0 suitable for the length of the insert sheet SS in the conveyance direction.

With the construction of this embodiment, it is possible to prevent the insert interval S0 from being excessively larger than required. If differently sized insert sheets SS are used in a single print job, the insert interval S0 changes whenever to suit the length of the insert sheet SS in the conveyance direction. It is thus possible to insert sheet SS while preventing a drop in productivity.

Moreover, with the construction of this embodiment, after the trailing end of the preceding sheet S10, conveyed along the main conveyance passage 1A pass by the insert position P3 the inserter 2 feeds the insert sheet SS to the main conveyance passage 1A at the insert position P3. Here, the insert interval S0 is set according to the length of the insert sheet SS in the conveyance direction. Thus, before the leading end of the succeeding sheet S20 reaches the insert position P3, the feeding of the insert sheet SS can be completed. It is thereby possible to prevent the insert sheet SS from colliding with another sheet S conveyed along the main conveyance passage 1A.

Moreover, with the construction of this embodiment, in the simplex print job that involves the insert process, the feeding of the sheet is controlled as shown in FIG. 3. In the standard duplex print job that involves the insert process, the feeding of the sheet is controlled as shown in FIG. 4. In the high-speed duplex print job that involves the insert process, the feeding of the sheet is controlled as shown in FIG. 5. In this way, in each print job; it is possible to insert the insert sheet SS while preventing a drop in productivity.

It should be understood that the embodiment disclosed herein is in every aspect illustrative and not restrictive. The scope of the present disclosure is defined not by the description of the embodiment given above but by the appended claims, and encompasses any modifications made without departure from the scope and sense equivalent to those claims.

What is claimed is:

1. An image forming apparatus, comprising:

a main conveyance passage leading from a cassette, in which a sheet is set, to a discharge position via a print position and an insert position;

a print portion that, in a print job, feeds and conveys the sheet from the cassette to the main conveyance passage and prints an image on the sheet passing by the print position;

an inserter that performs an insert process in which the inserter feeds an insert sheet to the main conveyance passage at the insert position and thereby inserts the insert sheet between sheets conveyed one after another along the main conveyance passage;

a reversing conveyance passage that branches off the main conveyance passage at a branch position downstream of the print position in a sheet conveyance direction and that connects to the main conveyance passage at a connection position upstream of the print position in the sheet conveyance direction; and a main control portion that controls the print portion and the inserter, wherein in the print job involving the insert process, the print portion conveys, while securing an insert interval between a preceding sheet, which is a sheet immediately preceding the insert sheet, and a succeeding sheet, which is a sheet immediately following the insert sheet, the preceding sheet and the succeeding sheet one after another, and the print portion automatically changes the insert interval according to a length of the insert sheet in the sheet conveyance direction, wherein the print job can be a standard duplex print job in which images are printed on both sides of the sheet, in the standard duplex print job, the print portion, switches back the sheet fed from the cassette to the main conveyance passage to draw the sheet into the reversing conveyance passage at the branch position, and after feeding the sheet in the reversing conveyance passage back to the main conveyance passage at the connection position, feeds a following sheet from the cassette to the main conveyance passage, and in the standard duplex print job involving the insert process, when the Nth sheet is the insert sheet fed from the inserter, the print portion feeds the (N+1)th sheet from the cassette to the main conveyance passage at a sheet feed timing as instructed by the main control portion, and the longer the insert sheet is in the sheet conveyance direction, the more the main control portion delays the sheet feed timing of the (N+1)th sheet, and the shorter the insert sheet is in the sheet conveyance direction, the more the main control portion expedites the sheet feed timing of the (N+1)th sheet.

2. The image forming apparatus according to claim 1, wherein in the print job involving the insert process, after a trailing end of the preceding sheet conveyed along the main conveyance passage has passed by the insert position, the inserter feeds the insert sheet to the main conveyance passage at the insert position.

3. The image forming apparatus according to claim 1, wherein the print job can be a simplex print job in which an image is printed on one side of the sheet, and in the simplex print job involving the insert process, when an Nth sheet is the insert sheet fed from the inserter, the print portion feeds the (N+1)th sheet from the cassette to the main conveyance passage at the sheet feed timing as instructed by the main control portion, and the longer the insert sheet is in the sheet conveyance direction, the more the main control portion delays the sheet feed timing of the (N+1)th sheet, and the shorter the insert sheet is in the sheet conveyance direction, the more the main control portion expedites the sheet feed timing of the (N+1)th sheet.

4. An image forming apparatus, comprising:

a main conveyance passage leading from a cassette, in which a sheet is set, to a discharge position via a print position and an insert position;

a print portion that, in a print job, feeds and conveys the sheet from the cassette to the main conveyance passage and prints an image on the sheet passing by the print position;

an inserter that performs an insert process in which the inserter feeds an insert sheet to the main conveyance passage at the insert position and thereby inserts the insert sheet between sheets conveyed one after another along the main conveyance passage;

a reversing conveyance passage that branches off the main conveyance passage at a branch position downstream of the print position in a sheet conveyance direction and that connects to the main conveyance passage at a connection position upstream of the print position in the sheet conveyance direction; and a main control portion that controls the print portion and the inserter, wherein in the print job involving the insert process, the print portion conveys, while securing an insert interval between a preceding sheet, which is a sheet immediately preceding the insert sheet, and a succeeding sheet, which is a sheet immediately following the insert sheet, the preceding sheet and the succeeding sheet one after another, and the print portion automatically changes the insert interval according to a length of the insert sheet in the sheet conveyance direction;

wherein the print job can be a high-speed duplex print job in which images are printed on both sides of the sheet, in the high-speed duplex print job, the print portion, switches back a first sheet fed from the cassette to the main conveyance passage to draw the first sheet into the reversing conveyance passage at the branch position, before feeding the first sheet back to the main conveyance passage at the connection position, feeds a second sheet following the first sheet from the cassette to the main conveyance passage, after feeding the second sheet, switches back the second sheet to draw into the reversing conveyance passage at the branch position and feeds the first sheet back to the main conveyance passage at the connection position, after feeding back the first sheet, before feeding the second sheet back to the main conveyance passage at the connection point, feeds a third sheet following the second sheet from the cassette to the main conveyance passage, and after feeding the third sheet, feeds the second sheet back to the main conveyance passage at the connection position, and in the high-speed duplex print job involving the insert process, when the Nth sheet is the insert sheet fed from the inserter, the print portion feeds the (N−1)th sheet from the reversing conveyance passage back to the main conveyance passage at a sheet feeding-back timing as instructed by the main control portion, and the longer the insert sheet is in the sheet conveyance direction, the more the main control portion delays the sheet feeding-back timing of the (N−1)th sheet, and the shorter the insert sheet is in the sheet conveyance direction, the more the main control portion expedites the sheet feeding-back timing of the (N−1)th sheet.

5. The image forming apparatus according to claim 4, wherein the print portion feeds the (N+2)th sheet from the cassette to the main conveyance passage at a sheet feed timing as instructed by the main control portion, and the longer the insert sheet is in the sheet conveyance direction, the more the main control portion delays the sheet feed timing of the (N+2)th sheet, and the shorter the insert sheet is in the sheet conveyance direction, the more the main control portion expedites the sheet feed timing of the (N+2)th sheet.

6. The image forming apparatus according to claim 4, wherein in the print job involving the insert process, after a trailing end of the preceding sheet conveyed along the main conveyance passage has passed by the insert position, the inserter feeds the insert sheet to the main conveyance passage at the insert position.

7. The image forming apparatus according to claim 4, wherein the print job can be a simplex print job in which an image is printed on one side of the sheet, and in the simplex print job involving the insert process, when an Nth sheet is the insert sheet fed from the inserter, the print portion feeds the (N+1)th sheet from the cassette to the main conveyance passage at a sheet feed timing as instructed by the main control portion, and the longer the insert sheet is in the sheet conveyance direction, the more the main control portion delays the sheet feed timing of the (N+1)th sheet, and the shorter the insert sheet is in the sheet conveyance direction, the more the main control portion expedites the sheet feed timing of the (N+1)th sheet.

8. A method of controlling an image forming apparatus that, in a print job, feeds and conveys a sheet from a cassette in which the sheet is set to a main conveyance passage leading via a print position and an insert position to a discharge position and that prints an image on the sheet passing by the print position, the method comprising:

in the print job involving an insert process in which an insert sheet is fed to the main conveyance passage at the insert position to be inserted between sheets conveyed one after another along the main conveyance passage, conveying, while securing an insert interval between a preceding sheet, which is a sheet immediately preceding the insert sheet, and a succeeding sheet, which is a sheet immediately following the insert sheet, the preceding sheet and the succeeding sheet one after another, automatically changing the insert interval according to a length of the insert sheet in a sheet conveyance direction, and the image forming apparatus includes a reversing conveyance passage that branches off the main conveyance passage at a branch position downstream of the print position in the sheet conveyance direction and that connects to the main conveyance passage at a connection position upstream of the print position in the sheet conveyance direction, wherein the print job can be a standard duplex print job in which images are printed on both sides of the sheet, in the standard duplex print job, the sheet fed from the cassette to the main conveyance passage is switched back to draw the sheet into the reversing conveyance passage at the branch position, and after feeding the sheet in the reversing conveyance passage back to the main conveyance passage at the connection position, feeds a following sheet from the cassette to the main conveyance passage, in the standard duplex print job involving the insert process, when the Nth sheet is the insert sheet fed from the inserter, the (N+1)th sheet is fed from the cassette to the main conveyance passage at a sheet feed timing as set based on the length of the insert sheet in the sheet conveyance direction, and the longer the insert sheet is in the sheet conveyance direction, the more the sheet feed timing of the (N+1)th sheet is delayed, and the shorter the insert sheet is in the sheet conveyance direction, the more the sheet feed timing of the (N+1)th sheet is expedited.

9. A method of controlling an image forming apparatus that, in a print job, feeds and conveys a sheet from a cassette in which the sheet is set to a main conveyance passage leading via a print position and an insert position to a discharge position and that prints an image on the sheet passing by the print position, the method comprising:

in the print job involving an insert process in which an insert sheet is fed to the main conveyance passage at the insert position to be inserted between sheets conveyed one after another along the main conveyance passage, conveying, while securing an insert interval between a preceding sheet, which is a sheet immediately preceding the insert sheet, and a succeeding sheet, which is a sheet immediately following the insert sheet, the preceding sheet and the succeeding sheet one after another, automatically changing the insert interval according to a length of the insert sheet in a sheet conveyance direction, and the image forming apparatus includes a reversing conveyance passage that branches off the main conveyance passage at a branch position downstream of the print position in the sheet conveyance direction and that connects to the main conveyance passage at a connection position upstream of the print position in the sheet conveyance direction, wherein the print job can be a high-speed duplex print job in which images are printed on both sides of the sheet, in the high-speed duplex print job, a first sheet fed from the cassette to the main conveyance passage is switched back to draw the first sheet into the reversing conveyance passage at the branch position, before feeding the first sheet back to the main conveyance passage at the connection position, feeds a second sheet following the first sheet from the cassette to the main conveyance passage, after feeding the second sheet, the second sheet is switched back to draw into the reversing conveyance passage at the branch position and feeds the first sheet back to the main conveyance passage at the connection position, after feeding back the first sheet, before feeding the second sheet back to the main conveyance passage at the connection point, feeds a third sheet following the second sheet from the cassette to the main conveyance passage, and after feeding the third sheet, feeds the second sheet back to the main conveyance passage at the connection position, in the high-speed duplex print job involving the insert process, when the Nth sheet is the insert sheet fed from the inserter, the (N−1)th sheet is fed from the reversing conveyance passage back to the main conveyance passage at a sheet feeding-back timing as set based on the length of the insert sheet in the sheet conveyance direction, and the longer the insert sheet is in the sheet conveyance direction, the more the sheet feeding-back timing of the (N−1)th sheet is delayed, and the shorter the insert sheet is in the sheet conveyance direction, the more the sheet feeding-back timing of the (N−1)th sheet is expedited.

* * * * *